US008069035B2

(12) United States Patent
Yoshida

(10) Patent No.: US 8,069,035 B2
(45) Date of Patent: Nov. 29, 2011

(54) SCALABLE ENCODING APPARATUS, SCALABLE DECODING APPARATUS, AND METHODS OF THEM

(75) Inventor: Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 901 days.

(21) Appl. No.: 12/089,983

(22) PCT Filed: Oct. 13, 2006

(86) PCT No.: PCT/JP2006/320444

§ 371 (c)(1),
(2), (4) Date: Apr. 11, 2008

(87) PCT Pub. No.: WO2007/043642

PCT Pub. Date: Apr. 19, 2007

(65) Prior Publication Data

US 2009/0030677 A1 Jan. 29, 2009

(30) Foreign Application Priority Data

Oct. 14, 2005 (JP) ..... 2005-300777
Dec. 28, 2005 (JP) ..... 2005-379335

(51) Int. Cl.
*G10L 21/00* (2006.01)
*G10L 21/02* (2006.01)
*G10L 19/00* (2006.01)

(52) U.S. Cl. ..... 704/201; 704/227; 704/501

(58) Field of Classification Search ..... None
See application file for complete search history.

(56) References Cited

U.S. PATENT DOCUMENTS 6,680,972 B1 * 1/2004 Liljeryd et al. ..... 375/240
6,957,182 B1 * 10/2005 Turnbull et al. ..... 704/229
7,277,849 B2 * 10/2007 Streich et al. ..... 704/229
7,729,905 B2 * 6/2010 Sato et al. ..... 704/219
7,835,915 B2 * 11/2010 Kim et al. ..... 704/500

(Continued)

FOREIGN PATENT DOCUMENTS

EP 1599868 11/2005

(Continued)

OTHER PUBLICATIONS

Morita T. et al., "A Design of Error Robust Scalable Coder Based on MPE-4/Audio".

(Continued)

*Primary Examiner* — Brian Albertalli
(74) *Attorney, Agent, or Firm* — Greenblum & Bernstein, P.L.C.

(57) ABSTRACT

A scalable encoding apparatus capable of suppressing the quality degradation of a decoded signal without increasing the bit rate. In this apparatus, a core layer encoding part (101) and an extended layer encoding part (102) encode an input signal for each of audio frames. When a replacement determining part (103) determines that a degree to which the input signal changes between a preceding frame and a current frame is equal to or greater than a predetermined value or that a degree, to which the quality of the decoded signal is improved by an extended layer encoding process in the preceding frame, is equal to less than a predetermined level, a replacing part (105) replaces a part of an extended layer encoded data of the preceding frame by a core layer encoded data of the current frame. That is, a transmitting part (108) transmits, as a backup, the core layer encoded data of the current frame to a decoding end in advance.

21 Claims, 13 Drawing Sheets

U.S. PATENT DOCUMENTS

| | | | | |
|---|---|---|---|---|
| 7,848,921 | B2 * | 12/2010 | Ehara | 704/216 |
| 7,895,035 | B2 * | 2/2011 | Ehara | 704/219 |
| 2002/0101369 | A1 | 8/2002 | Gottesman | |
| 2002/0159472 | A1 | 10/2002 | Bialik | |
| 2007/0253481 | A1 | 11/2007 | Oshikiri | |
| 2007/0271092 | A1 | 11/2007 | Ehara et al. | |
| 2008/0059166 | A1 | 3/2008 | Ehara | |
| 2008/0126082 | A1 | 5/2008 | Ehara et al. | |

FOREIGN PATENT DOCUMENTS

| | | |
|---|---|---|
| EP | 1699043 | 9/2006 |
| JP | 2002-534894 | 10/2002 |
| JP | 2003-241799 | 8/2003 |
| JP | 2005-222014 | 8/2005 |
| JP | 2006-520487 | 9/2006 |
| WO | 00/41315 | 7/2000 |
| WO | 2004/081918 | 9/2004 |
| WO | 2005/066937 | 7/2005 |
| WO | 2005/086138 | 9/2005 |

OTHER PUBLICATIONS

Search report from E.P.O., mail date is Feb. 10, 2011.

ISO/IEC 14496-3: 2001 (E) Prt-3 Audio (MPEG-4) Subpart-3 Speech Coding (CELP).

ISO/IEC 14496-3: 2001 (E) Prt-3 Audio (MPEG-4) Subpart-1 Main Annex1 .B (Informative) Error Protection tool.

* cited by examiner

| ROW / COLUMN | | ··· | 1 | 2 | 3 | 4 | 5 | ··· |
|---|---|---|---|---|---|---|---|---|
| 1 | INPUT SPEECH SIGNAL | ··· | I(m−3) | I(m−2) | I(m−1) | I(m) | I(m+1) | ··· |
| 2 | CORE LAYER ENCODED DATA GENERATED BY CORE LAYER ENCODING SECTION 101 | ··· | Ec(m−3) | Ec(m−2) | Ec(m−1) | Ec(m) | Ec(m+1) | ··· |
| 3 | ENHANCEMENT LAYER ENCODED DATA GENERATED BY ENHANCEMENT LAYER ENCODING SECTION 102 | ··· | Ee(m−3) | Ee(m−2) | Ee(m−1) | Ee(m) | Ee(m+1) | ··· |
| 4 | CORE LAYER ENCODED DATA TRANSMITTED BY TRANSMITTING SECTION 108 WHEN REPLACING SECTION 105 IS NOT PROVIDED | ··· | Ec(m−4) | Ec(m−3) | Ec(m−2) | Ec(m−1) | Ec(m) | ··· |
| 5 | ENHANCEMENT LAYER ENCODED DATA TRANSMITTED BY TRANSMITTING SECTION 108 WHEN REPLACING SECTION 105 IS NOT PROVIDED | ··· | Ee(m−4) | Ee(m−3) | Ee(m−2) | Ee(m−1) | Ee(m) | ··· |
| 6 | REPLACING FLAG TRANSMITTED BY TRANSMITTING SECTION 108 | ··· | flag(m−4)=0 | flag(m−3)=1 | flag(m−2)=0 | flag(m−1)=1 | flag(m)=0 | ··· |
| 7 | CORE LAYER ENCODED DATA ACTUALLY TRANSMITTED BY TRANSMITTING SECTION 108 | ··· | Ec(m−4) | Ec(m−3) | Ec(m−2) | Ec(m−1) | Ec(m) | ··· |
| 8 | ENHANCEMENT LAYER ENCODED DATA ACTUALLY TRANSMITTED BY TRANSMITTING SECTION 108 | ··· | Ee(m−4) | Ec(m−2) | Ee(m−2) | Ec(m) | Ee(m) | ··· |

FIG.3

| ROW / COLUMN | | ··· | 1 | 2 | 3 | 4 | 5 | ··· |
|---|---|---|---|---|---|---|---|---|
| 1 | INPUT SPEECH SIGNAL | ··· | I(m−3) | I(m−2) | I(m−1) | I(m) | I(m+1) | ··· |
| 2 | CORE LAYER ENCODED DATA GENERATED BY CORE LAYER ENCODING SECTION 101 | ··· | Ec(m−3) | Ec(m−2) | Ec(m−1) | Ec(m) | Ec(m+1) | ··· |
| 3 | ENHANCEMENT LAYER ENCODED DATA GENERATED BY ENHANCEMENT LAYER ENCODING SECTION 102 | ··· | Ee(m−3) | Ee(m−2) | Ee(m−1) | Ee(m) | Ee(m+1) | ··· |
| 4 | CORE LAYER ENCODED DATA TRANSMITTED BY TRANSMITTING SECTION 108 WHEN REPLACING SECTION 105 IS NOT PROVIDED | ··· | Ec(m−4) | Ec(m−3) | Ec(m−2) | Ec(m−1) | Ec(m) | ··· |
| 5 | ENHANCEMENT LAYER ENCODED DATA TRANSMITTED BY TRANSMITTING SECTION 108 WHEN REPLACING SECTION 105 IS NOT PROVIDED | ··· | Ee(m−4) | Ee(m−3) | Ee(m−2) | Ee(m−1) | Ee(m) | ··· |
| 6 | REPLACING FLAG TRANSMITTED BY TRANSMITTING SECTION 108 | ··· | flag(m−4)=0 | flag(m−3)=1 | flag(m−2)=0 | flag(m−1)=1 | flag(m)=0 | ··· |
| 7 | CORE LAYER ENCODED DATA ACTUALLY TRANSMITTED BY TRANSMITTING SECTION 108 | ··· | Ec(m−4) | Ec(m−3) | Ec(m−2) | Ec(m−1) | Ec(m) | ··· |
| 8 | ENHANCEMENT LAYER ENCODED DATA ACTUALLY TRANSMITTED BY TRANSMITTING SECTION 108 | ··· | Ee(m−4) | Ec(m−2) | Ee(m−2) | Ec(m) | Ee(m) | ··· |
| 9 | CORE LAYER ENCODED DATA RECEIVED BY RECEIVING SECTION 201 | ··· | Ec(m−4) | ~~Ec(m−3)~~ | Ec(m−2) | Ec(m−1) | ~~Ec(m)~~ | ··· |
| 10 | ENHANCEMENT LAYER ENCODED DATA RECEIVED BY RECEIVING SECTION 201 | ··· | Ee(m−4) | ~~Ec(m−2)~~ | Ee(m−2) | Ec(m) | ~~Ee(m)~~ | ··· |

PACKET LOSS PACKET LOSS

FIG.6

SCALABLE ENCODING APPARATUS, SCALABLE DECODING APPARATUS, AND METHODS OF THEM

TECHNICAL FIELD

The present invention relates to a scalable encoding apparatus, scalable decoding apparatus, scalable encoding method and scalable decoding method.

BACKGROUND ART

In speech data communication on IP network, to realize network traffic control and multicast communication on network, speech encoding employing a scalable configuration is anticipated. A scalable configuration is a configuration that enables the receiving side to decode speech data even from partial encoded data.

In scalable encoding, the transmitting side encodes an input speech signal in a layered manner, and transmits encoded data formed with a plurality of layers from lower layers including the core layer to higher layers including the enhancement layer. The receiving side can decode a signal using encoded data from lower layers to an arbitrary layer (for example, see Non-Patent Document 1).

By reducing the loss rate of encoded data in lower layers including the core layer rather than encoded data in higher layers to control packet loss on the IP network, it is possible to improve robustness against packet loss.

If loss of encoded data in lower layers including the core layer cannot be avoided, it is possible to perform error compensation using encoded data received in the past (for example, see Non-Patent Document 2). That is, if encoded data in lower layers including the core layer in layered encoded data obtained by performing scalable encoding processing on an input speech signal in frame units, is lost and cannot be received due to packet loss, the receiving side can perform error compensation using encoded data of a frame received in the past and can perform decoding. Therefore, it is possible to suppress quality degradation of a decoded signal to some extent when a packet loss occurs.

Non-Patent Document 1: ISO/IEC 14496-3:2001(E) Prt-3 Audio (MPEG-4) Subpart-3 Speech Coding (CELP)

Non-Patent Document 2: ISO/IEC 14496-3:2001(E) Prt-3 Audio (MPEG-4) Subpart-1 Main Annex1.B (Informative) Error Protection tool

DISCLOSURE OF INVENTION

Problems to be Solved by the Invention

However, there is a problem that, if core layer encoded data which changes substantially in a speech signal, such as the onset of a speech signal, is lost, even if error compensation is performed using encoded data of a past frame as described above, the accuracy of compensation deteriorates substantially and quality of a decoded speech at the receiving side degrades.

It is therefore an object of the present invention to provide a scalable encoding apparatus, scalable decoding apparatus, scalable encoding method and scalable decoding method that suppress quality degradation of a decoded signal, even when core layer encoded data is lost and error compensation cannot be performed accurately using encoded data of a past frame.

Means for Solving the Problem

The scalable encoding apparatus according to the present invention is configured with at least a lower layer and a higher layer and includes: a lower layer encoding section that performs encoding in the lower layer to generate lower layer encoded data; a higher layer encoding section that performs encoding in the higher layer to generate higher layer encoded data; a duplicating section that generates duplicated data of the lower layer encoded data; and a replacing section that replaces part of the higher layer encoded data with the duplicated data.

The scalable decoding apparatus according to the present invention is configured with at least a lower layer and a higher layer and includes: a demultiplexing section that demultiplexes duplicated data of lower layer encoded data from higher layer encoded data; a detecting section that detects a loss of a frame; a lower layer decoding section that decodes the duplicated data to generate first decoded data when the loss of a frame is detected; and a higher layer decoding section that, when the loss of a frame is detected, compensates for the lost frame using the first decoded data to generate second decoded data.

Advantageous Effect of the Invention

According to the present invention, it is possible to suppress quality degradation of a decoded signal by performing error compensation without increasing the bit rate.

BRIEF DESCRIPTIONS OF DRAWINGS

FIG. 3 illustrates details of replacement of enhancement layer encoded data with core layer encoded data;

FIG. 6 illustrates decoding processing according to Embodiment 1;

BEST MODE FOR CARRYING OUT THE INVENTION

Embodiments of the present invention will be described in detail below with reference to the accompanying drawings.

Embodiment 1

Figure 1:
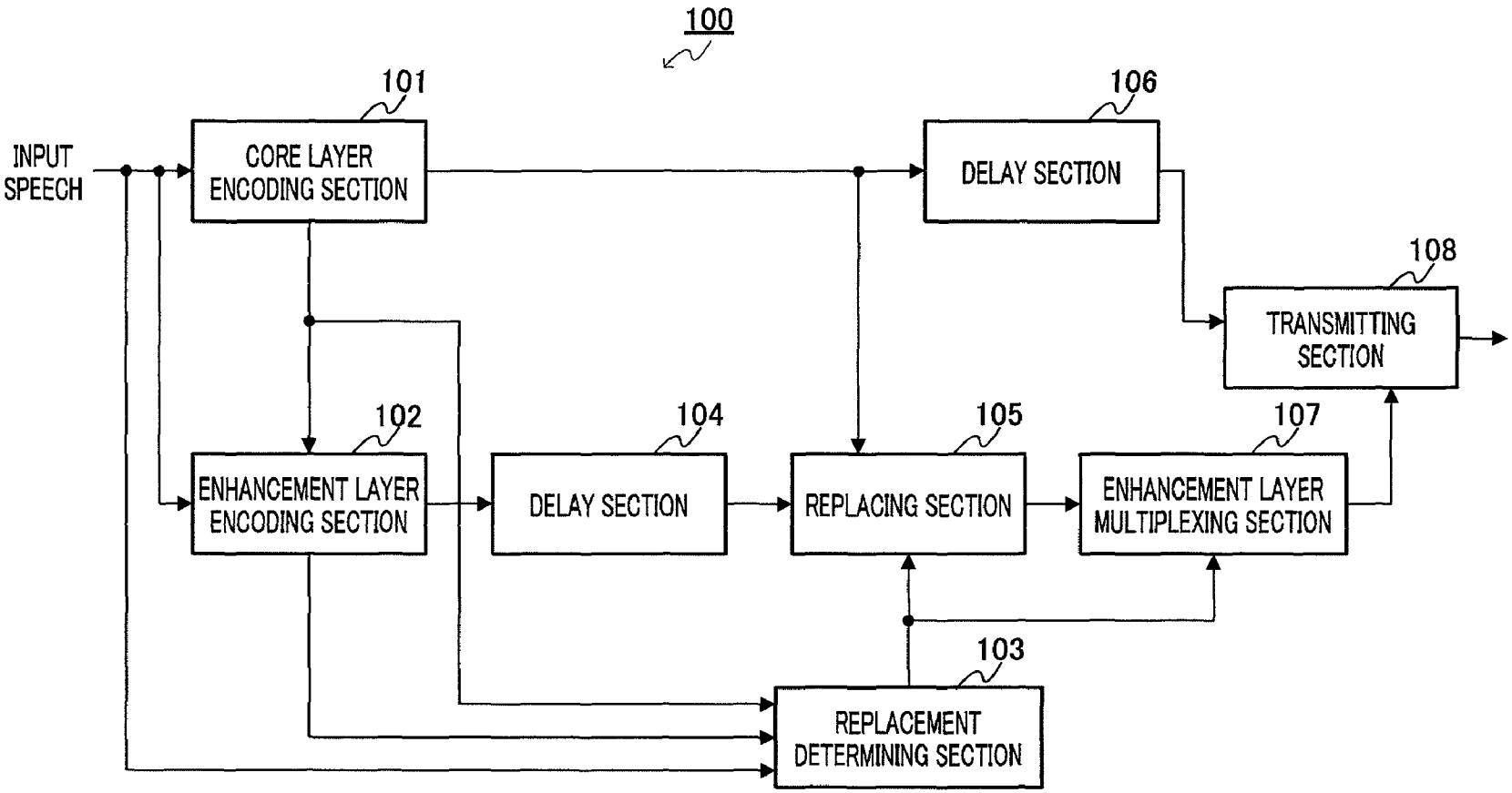
FIG. 1 is a block diagram showing the main configuration of a scalable encoding apparatus according to Embodiment 1.

FIG. 1 is a block diagram showing the main configuration of scalable encoding apparatus 100 according to Embodiment 1 of the present invention. Scalable encoding apparatus 100 adopts a two-layer configuration including the core layer and the enhancement layer, and performs scalable encoding processing on an inputted speech signal in speech frame units. A case will be described as an example where speech signal I(m) of the m-th frame (where m is an integer) is inputted to scalable encoding apparatus 100.

Core layer encoding section 101 performs encoding processing on a signal which will be the core component of the input speech signal, to generate core layer encoded data. If the input speech signal is a wideband speech signal having a 7 kHz bandwidth and band scalable encoding is performed, the core component signal refers to, for example, a signal having a telephone bandwidth (3.4 kHz) generated by limiting the band of the wideband speech signal. The decoding side can ensure quality of a decoded signal to some extent, even if decoding is performed using only this core layer encoded data. Core layer encoding section 101 performs core layer encoding processing using input speech signal I(m) to generate core layer encoded data Ec(m) of the m-th frame. Generated Ec(m) is inputted to delay section 106 and replacing section 105. That is, data inputted to replacing section 105 is duplicated data of the data inputted to delay section 106. Core layer encoding section 101 may adopt a configuration for generating core layer encoded data by performing encoding processing on the input speech signal itself.

Enhancement layer encoding section 102 obtains a local decoded signal by decoding Ec(m) inputted from core layer encoding section 101 and compares this decoded signal with the input speech signal, and thereby calculates the residual signal components that cannot be expressed with Ec(m) in the input speech signal (for example, coding error signal components in the core layer or high-band signal components which are not encoded in the core layer when band scalable encoding is performed), performs encoding processing on these components to generate enhancement layer encoded data. The decoding side can improve quality of a decoded signal by performing decoding using enhancement layer encoded data in addition to core layer encoded data. Enhancement layer encoding section 102 generates enhancement layer encoded data Ee(m) of the m-th frame using input speech signal I(m) and Ec(m) inputted from core layer encoding section 101.

Replacement determining section 103 performs replacement determining processing of determining whether or not to replace enhancement layer encoded data Ee(m−1) of the (m−1)-th frame with core layer encoded data Ec(m) of the m-th frame, using input speech signal I(m), Ec(m) inputted from core layer encoding section 101 and Ee(m) inputted from enhancement layer encoding section 102. Replacement determining section 103 outputs a replacement determining flag "flag(m−1)" showing this determination result, to replacing section 105 and enhancement layer multiplexing section 107.

Delay section 104 receives enhancement layer encoded data Ee(m) of the m-th frame from enhancement layer encoding section 102, and outputs enhancement layer encoded data Ee(m−1) of the (m−1)-th frame. That is, Ee(m−1) outputted from delay section 104 is obtained by delaying enhancement layer encoded data Ee(m−1) of the (m−1)-th frame, which is inputted from enhancement layer encoding section 102 in encoding processing of one frame before, by one frame, and by outputting the result in encoding processing for the m-th frame.

Replacing section 105 performs replacing processing based on the value of replacement determining flag "flag(m−1)" inputted from replacement determining section 103. That is, when flag(m−1) is 0, Ee(m−1) inputted from delay section 104 is outputted as is to enhancement layer multiplexing section 107. On the other hand, if flag(m−1) is 1, replacing section 105 replaces the content of Ee(m−1) inputted from delay section 104 with Ec(m) inputted from core layer encoding section 101, and outputs the result to enhancement layer multiplexing section 107.

Delay section 106 receives Ec(m) inputted from core layer encoding section 101 and outputs Ec(m−1). That is, Ec(m−1) outputted from delay section 106 is obtained by delaying core layer encoded data Ec(m−1) of the (m−1)-th frame, which is inputted from core layer encoding section 101 in encoding processing of one frame before, by one frame, and by outputting the result in encoding processing for the m-th frame.

Enhancement layer multiplexing section 107 performs multiplexing processing on replacement determining flag "flag(m−1)" inputted from replacement determining section 103 and enhancement layer encoded data Ee(m−1) inputted from replacing section 105.

Figure 4:
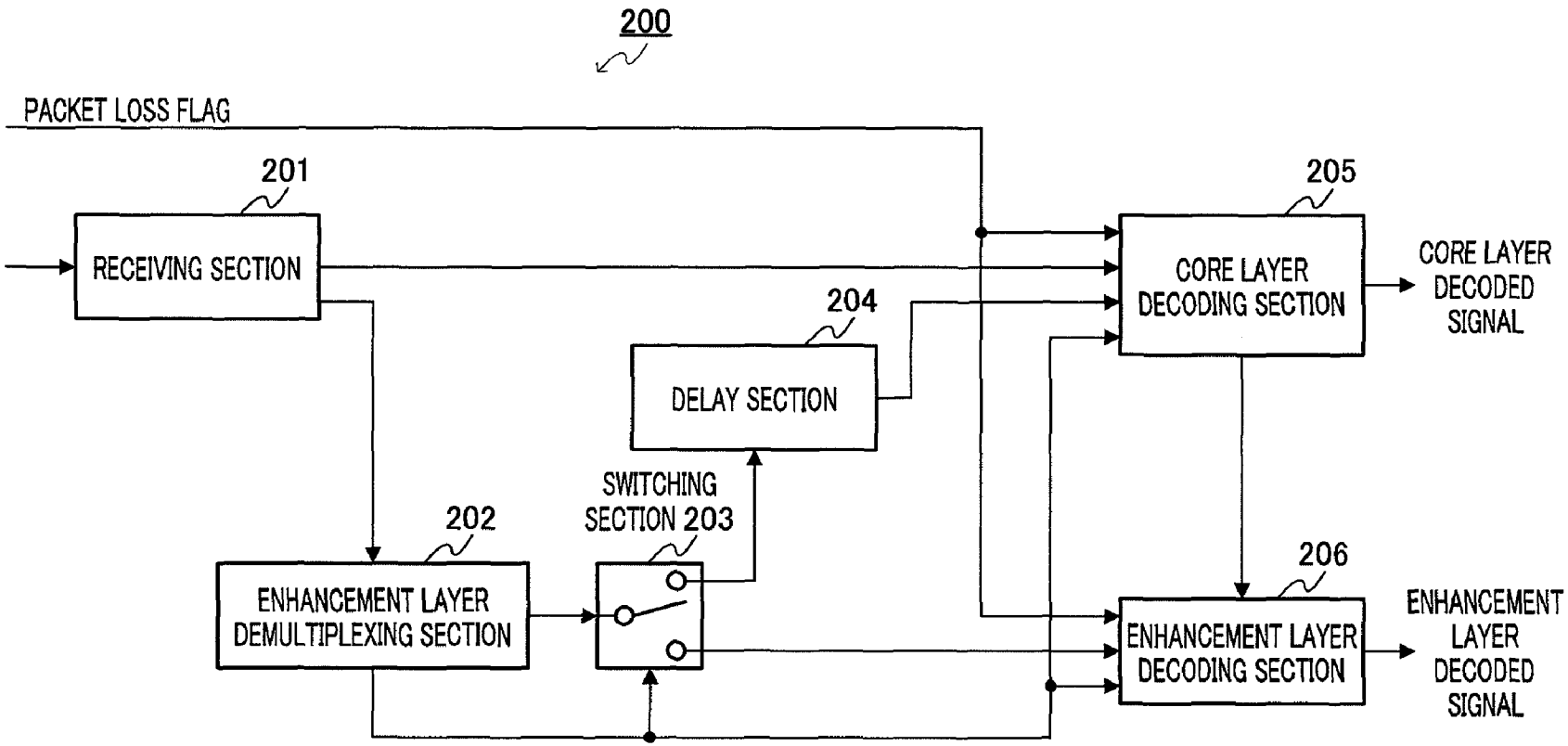
FIG. 4 is a block diagram showing the main configuration of a scalable decoding apparatus according to Embodiment 1.

Transmitting section 108 multiplexes core layer encoded data Ec(m−1) inputted from delay section 106, enhancement layer encoded data Ee(m−1) inputted from enhancement layer multiplexing section 107 and replacement determining flag "flag(m−1)", and transmits the result to scalable decoding apparatus (see FIG. 4).

As described above, scalable encoding apparatus 100 transmits core layer encoded data Ec(m−1) and enhancement layer encoded data Ee (m−1), which are delayed by one frame with respect to input speech signal I(m), to scalable decoding apparatus 200. The content of enhancement layer encoded data Ee(m−1) is enhancement layer encoded data Ee(m−1) of the (m−1)-th frame itself or core layer encoded data Ec(m) of the m-th frame. That is, when the (m−1)-th frame is the current frame, the m-th frame is a future frame, and scalable encoding apparatus 100 replaces enhancement layer encoded data of the current frame with duplicated data of core layer encoded data of the future frame, and transmits the result to scalable decoding apparatus 200. In other words, when the m-th frame is the current frame, the (m−1)-th frame is a past frame, and scalable encoding apparatus 100 replaces enhancement layer encoded data of the past frame with duplicated data of core layer encoded data of the current frame, and transmits the result to scalable decoding apparatus 200.

Figure 2:
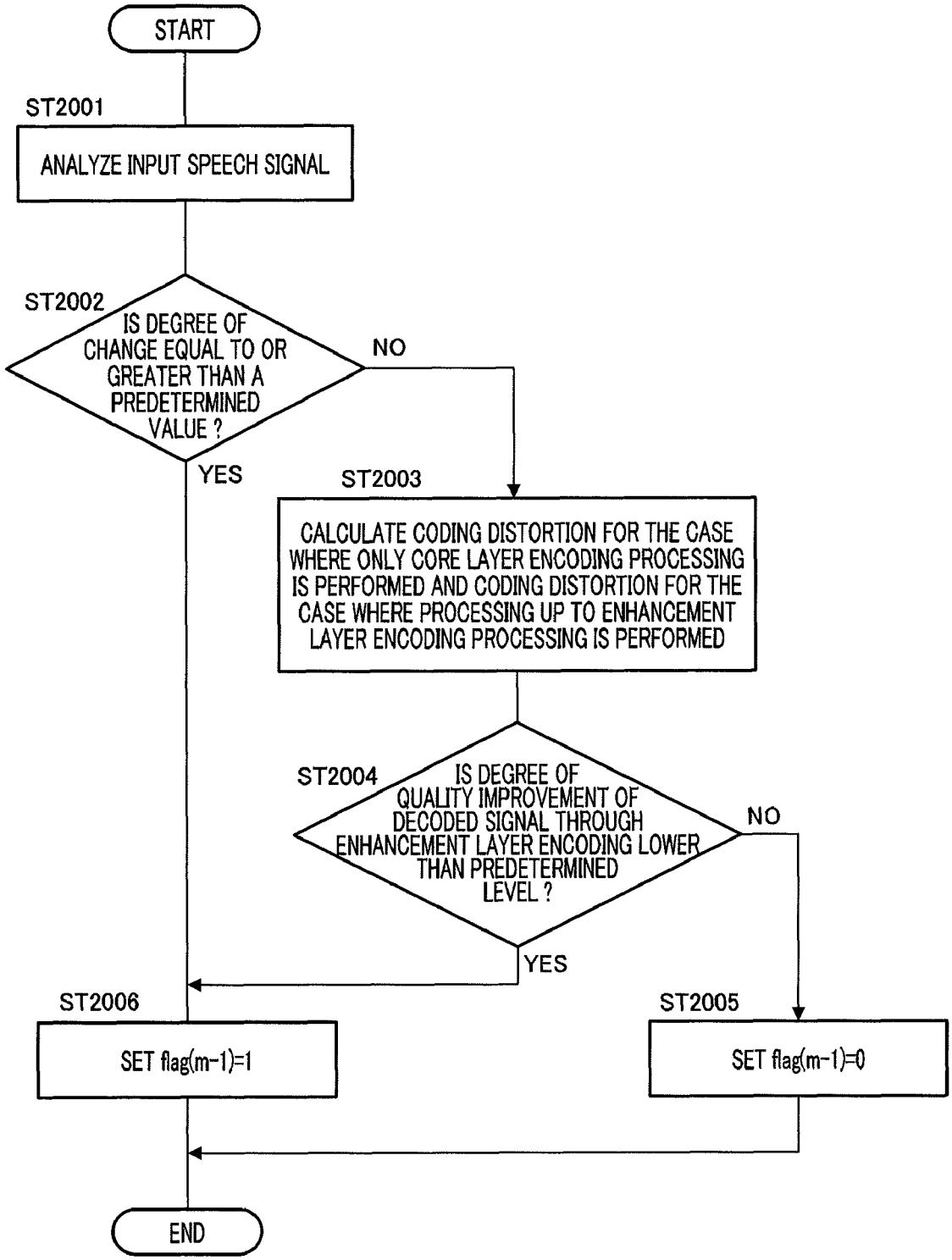
FIG. 2 is a flowchart showing the steps of replacement determining processing of a replacement determining section according to Embodiment 1.

FIG. 2 is a flowchart showing the steps of replacement determining processing of replacement determining section 103.

In step (hereinafter "ST") 2001, replacement determining section 103 analyzes an input speech signal and calculates the degree of change of characteristic parameters, such as power of the input speech signal, pitch analysis parameter (pitch period and pitch prediction gain) and LPC spectrum. For example, the difference between the power of the input speech signal and the power of an input speech signal in a past frame is calculated in frame units and is regarded as a parameter showing the degree of change of the input speech signal.

In ST2002, replacement determining section 103 determines whether or not the degree of change of the input speech signal calculated in ST2001 is equal to or greater than a predetermined value. If a frame where a signal changes substantially from the past frame in a non-stationary signal, such as the onset of the speech signal and an unvoiced non-stationary consonant part, is lost, the decoding side cannot perform error compensation in a predetermined level of quality or above using encoded data of the past frame. Therefore, when the degree of change of the input speech signal is equal to or greater than the predetermined value (ST2002: "Yes"), it is determined that the decoding side cannot perform error compensation in a predetermined level of quality or above using the encoded data of the past frame, and replacement determining section 103 proceeds to the processing of ST2006. On the other hand, when the degree of change of the input speech signal is less than the predetermined value (ST2002: "No"), replacement determining section 103 proceeds to the processing of ST2003.

In ST2003, replacement determining section 103 calculates coding distortion for the case where only core layer encoding processing is performed, and coding distortion for the case where the processing up to enhancement layer encoding processing is performed.

In ST2004, replacement determining section 103 determines whether or not a degree of quality improvement of a decoded signal is equal to or lower than a predetermined level. To be more specific, if the difference between the two coding distortions calculated in ST2003 is equal to or less than a predetermined value, the degree of quality improvement of a decoded signal through enhancement layer encoding processing is determined to be equal to or lower than a predetermined level (ST2004: "Yes"). In this case, replacement determining section 103 proceeds to the processing of ST2006. On the other hand, when the degree of quality improvement of a decoded signal through enhancement layer encoding processing is higher than the predetermined level (ST2004: "No"), replacement determining section 103 proceeds to the processing of ST2005.

In ST2005, replacement determining section 103 sets replacement determining flag "flag(m−1)" to 0, which shows "no replacement." In ST2006, replacement determining section 103 sets replacement determining flag "flag(m−1)" to 1, which shows "replacement."

As described above, when encoded data of the m-th frame is lost, for the criterion for determining whether or not to replace enhancement layer encoded data Ee (m−1) with core layer encoded data Ec(m) of the next frame, replacement determining section 103 determines whether or not the decoding side can perform error compensation in a predetermined level of quality of above using encoded data of the past frame, or whether or not the degree of quality improvement of a decoded signal through enhancement layer encoding processing of the (m−1)-th frame is equal to or lower than the predetermined level.

FIG. 3 illustrates details of replacement of enhancement layer encoded data with core layer encoded data in scalable encoding apparatus 100. Here, processing for the input speech signal from the (m−3)-th to the (m+1)-th frame will be described as an example.

In this figure, the first row shows an input speech signal of each frame, the second and third rows show core layer encoded data generated in core layer encoding section 101 and enhancement layer encoded data generated in enhancement layer encoding section 102, respectively.

The fourth and fifth rows show core layer encoded data and enhancement layer encoded data, respectively, transmitted to scalable decoding apparatus 200 by transmitting section 108 on the assumption that replacing section 105 is not provided. As shown in the figure, the encoded data transmitted to scalable decoding apparatus 200 by transmitting section 108 is encoded data generated by core layer encoding section 101 and enhancement layer encoding section 102 through encoding processing of one frame before.

The sixth row shows the value of the replacement determining flag showing the determination result of replacement determining section 103. The seventh and eighth rows show core layer encoded data and enhancement layer encoded data, respectively, transmitted to scalable decoding apparatus 200 by transmitting section 108, when replacing section 105 performs replacing processing based on the value of the replacement determining flag. As shown in the figure, when replacement determining flag "flag(m−1)" is 1, Ee(m−1) is replaced with Ec(m). As shown by an arrow in the figure, as a result of the replacement, the data of the eighth row, the second column is the same as the data of the seventh row, the third column, and the data of the eighth row, the fourth column is the same as the data of the seventh row, the fifth column. That is, when replacement determining section 103 determines that Ec(m) needs to be transmitted to scalable decoding apparatus 200 in advance as a backup, replacing section 105 performs processing of replacing Ee(m−1) with Ec(m).

FIG. 4 is a block diagram showing the main configuration of scalable decoding apparatus 200. Scalable decoding apparatus 200 is configured with two layers of the core layer and the enhancement layer. A case will be described below where scalable decoding apparatus 200 receives encoded data of the n-th frame from scalable encoding apparatus 100 and performs decoding processing. Here, the relationship between n and m satisfies n=m−1.

Receiving section 201 receives from scalable encoding apparatus 100 encoded data where core layer encoded data Ec(n), enhancement layer encoded data Ee(n) and replacement determining flag "flag(n)" are multiplexed.

Enhancement layer demultiplexing section 202 performs demultiplexing processing on the data inputted from receiving section 201, where enhancement layer encoded data Ee(n) and replacement determining flag "flag(n)" are multiplexed, and demultiplexes the data into enhancement layer encoded data Ee(n) and replacement determining flag "flag(n)".

Switching section 203 determines whether the content of enhancement layer encoded data Ee(n) inputted from enhancement layer demultiplexing section 202 is Ee(n) or core layer encoded data Ec(n+1) of the next frame, based on the value of replacement determining flag "flag(n)" inputted from enhancement layer demultiplexing section 202. Based on the determination result, switching section 203 outputs core layer encoded data Ec(n+1) to delay section 204 when replacement determining flag "flag(n)" is 1, and outputs enhancement layer encoded data Ee(n) to enhancement layer decoding section 206 when replacement determining flag "flag(n)" is 0.

Delay section 204 receives core layer encoded data Ec(n+1) of the (n+1)-th frame from switching section 203 and outputs core layer encoded data Ec(n) of the n-th frame. That is, Ec(n) outputted from delay section 204 is obtained by delaying core layer encoded data Ec(n) of the n-th frame, which is inputted from switching section 203 in decoding processing of one frame before, by one frame, and by outputting the result in decoding processing of the (n+1)-th frame.

When no packet loss is detected based on a packet loss flag inputted from a packet loss detecting section (not shown), core layer decoding section 205 performs decoding processing using core layer encoded data Ec(n) inputted from receiving section 201 and replacement determining flag "flag(n)" inputted from enhancement layer demultiplexing section 202, to generate core layer decoded signal Dc(n). Further, when a packet loss occurs, core layer decoding section 205 performs decoding processing using core layer encoded data Ec(n) inputted from delay section 204, instead of using core layer encoded data Ec(n) inputted from receiving section 201. The processing in core layer decoding section 205 will be described later in detail.

When no packet loss is detected based on the packet loss flag inputted from the packet loss detecting section (not shown), enhancement layer decoding section 206 performs decoding processing using enhancement layer encoded data Ee(n) inputted from switching section 203, replacement determining flag "flag(n)" inputted from enhancement layer demultiplexing section 202, core layer encoded data Ec(n) inputted from core layer decoding section 205 and core layer decoded signal De(n) inputted from core layer decoding section 205, and outputs enhancement layer decoded signal De(n). Further, when a packet loss occurs, enhancement layer decoding section 206 performs error compensation using enhancement layer encoded data received in the past and compensated data generated in core layer decoding section 205.

Figure 5:
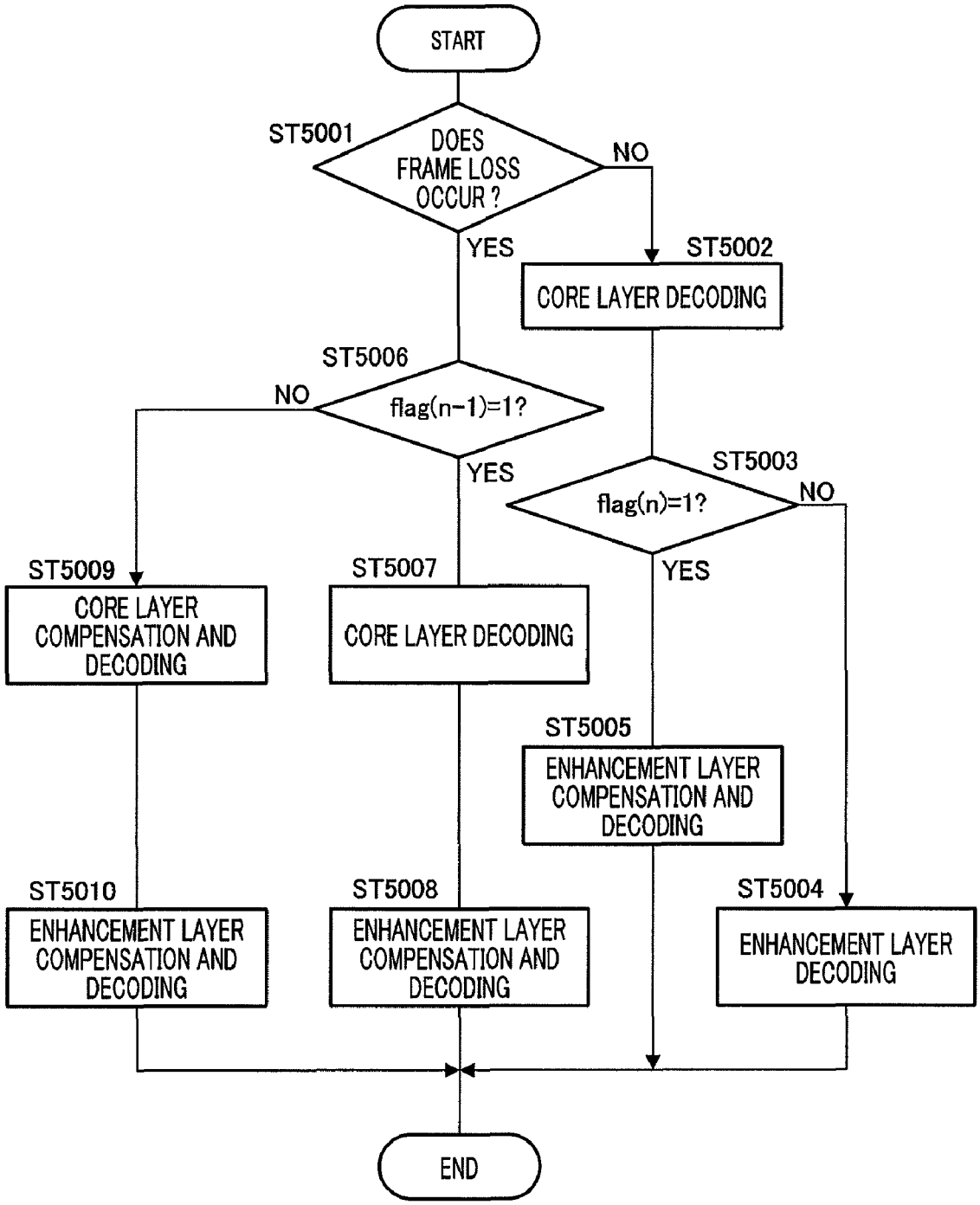
FIG. 5 is a flowchart showing the steps of error compensating processing and decoding processing in a core layer decoding section and an enhancement layer decoding section according to Embodiment 1.

FIG. 5 is a flowchart showing the steps of error compensation processing and decoding processing in core layer decoding section 205 and enhancement layer decoding section 206.

In ST5001, core layer decoding section 205 determines whether or not encoded data of the n-th frame is lost based on the packet loss flag. When it is determined that the frame is not lost (ST5001: "No"), core layer decoding section 205 proceeds to the processing of ST5002, and, when it is determined that the frame is lost (ST5001: "Yes"), core layer decoding section 205 proceeds to ST5006.

In ST5002, core layer decoding section 205 performs core layer decoding processing using core layer encoded data Ec(n) inputted from receiving section 201, to generate core layer decoded signal Dc(n).

In ST5003, enhancement layer decoding section 206 judges whether or not replacement determining flag "flag(n)" is 1. When the value of replacement determining flag "flag (n)" is judged to be 1 in ST5003 (ST5003: "Yes"), enhancement layer decoding section 206 proceeds to the processing of ST5005, and, when the value of replacement determining flag "flag(n)" is judged to be 0 (ST5003: "No"), enhancement layer decoding section 206 proceeds to ST5004.

In ST5004, enhancement layer decoding section 206 performs enhancement layer decoding processing using enhancement layer encoded data Ee(n) to generate enhancement layer decoded signal De(n).

In ST5005, enhancement layer decoding section 206 does not receive enhancement layer encoded data Ee(n) from switching section 203, and so performs error compensating processing and decoding processing using core layer encoded data Ec(n), core layer decoded signal Dc(n), enhancement layer encoded data Ee(n−1) of the (n−1)-th frame received in decoding processing of one frame before, and enhancement layer decoded signal De(n−1) of the (n−1)-th frame, to generate enhancement layer decoded signal De(n) of the n-th frame.

In ST5006, core layer decoding section 205 judges whether or not the value of replacement determining flag "flag(n−1)" of one frame before is 1. When the value of flag(n−1) is judged to be 1 (ST5006: "Yes"), the content of enhancement layer encoded data Ee(n−1) of the (n−1)-th frame received in decoding processing of one frame before can be judged to be core layer encoded data Ec(n) of the n-th frame. Therefore, core layer decoding section 205 proceeds to the processing of ST5007.

In ST5007, core layer decoding section 205 performs core layer decoding processing using core layer encoded data Ec(n) of the n-th frame received in decoding processing of one frame before, to generate core layer decoded signal Dc(n).

In ST5008, enhancement layer decoding section 206 performs error compensating processing and decoding processing using core layer decoded signal Dc(n), enhancement layer encoded data Ee(n−1) of one frame before, that is, the (n−1)-th frame, and enhancement layer decoded signal De(n−1), to generate enhancement layer decoded signal De(n) of the n-th frame.

On the other hand, when the value of flag(n−1) is judged to be 0 in ST5006 (ST5006: "No"), the content of enhancement layer encoded data Ee(n−1) of the (n−1)-th frame received in decoding processing of one frame before can be judged to be Ee(n−1) instead of core layer encoded data Ec(n) of the n-th frame, and so core layer decoding section 205 proceeds to the processing of ST5009.

In ST5009, core layer decoding section 205 performs error compensating processing and decoding processing using core layer encoded data Ec(n−1) and core layer decoded signal Dc(n−1) of one frame before, that is, the (n−1)-th frame, to generate core layer decoded signal Dc(n) of the n-th frame.

In ST5010, enhancement layer decoding section 206 performs error compensating processing and decoding processing using core layer encoded data Ec(n−1), core layer decoded signal Dc (n−1), enhancement layer encoded data Ee(n−1) and enhancement layer decoded signal De (n−1) of one frame before, that is, the (n−1)-th frame, to generate enhancement layer decoded signal De(n) of the n-th frame.

FIG. 6 illustrates decoding processing in scalable decoding apparatus 200. Here, FIG. 6, which uses basically the same data as the data shown in FIG. 3 and adds and shows encoded data received by scalable decoding apparatus 200, is different from FIG. 3 in that a frame lost due to packet loss is shown distinctly. That is, the ninth row shows core layer encoded data received by scalable decoding apparatus 200, and the tenth row shows enhancement layer encoded data received by scalable decoding apparatus 200. Here, an example is described where encoded data of the (m−3)-th frame and the m-th frame is lost.

When data shown in FIG. 6 is used, the steps of decoding processing in core layer decoding section 205 and enhancement layer decoding section 206 are as follows.

When scalable decoding apparatus 200 receives encoded data of the (m−4)-th frame or the (m−2)-th frame, decoding processing is performed in order from ST5001, ST5002, ST5003 and ST5004.

When scalable decoding apparatus 200 receives encoded data of the (m−1)-th frame, error compensating processing and decoding processing are performed in order from ST5001, ST5002, ST5003 and ST5005.

When scalable decoding apparatus 200 receives encoded data of the (m−3)-th frame, error compensating processing and decoding processing are performed in order from ST5001, ST5006, ST5009 and ST5010.

When scalable decoding apparatus 200 receives encoded data of the m-th frame, error compensating processing and decoding processing are performed in order from ST5001, ST5006, ST5007 and ST5008.

In this way, according to this embodiment, scalable encoding apparatus 100 determines for each frame whether or not a backup of core layer encoded data needs to be transmitted to scalable decoding apparatus 200 in advance, and replaces enhancement layer encoded data of the frame (past frame) one frame before the frame (current frame) with the core layer encoded data, for a specific frame for which transmission of the backup is determined to be necessary.

That is, when error compensation cannot be performed in a predetermined level of quality or above using encoded data of the past frame, or the degree of quality improvement of the decoded signal subjected to enhancement layer encoding processing in the past frame is equal to or lower than a predetermined level, scalable encoding apparatus 100 replaces enhancement layer encoded data of the past frame with core layer encoded data, and transmits the result to scalable decoding apparatus 200. Therefore, when scalable decoding apparatus 200 cannot receive encoded data of the current frame due to packet loss, decoding processing can be performed using core layer encoded data of the current frame received in decoding processing of the past frame, so that it is possible to suppress quality degradation of a decoded signal without increasing the bit rate.

Further, for a frame for which it is determined that core layer encoded data of the future frame does not need to be transmitted to scalable decoding apparatus 200 in advance as a backup, scalable encoding apparatus 100 transmits the frame as is to scalable decoding apparatus 200 without replacing enhancement layer encoded data (data of the present frame) with core layer encoded data of the subsequent frame (data of the future frame). Therefore, when a packet loss does not occur, scalable decoding apparatus 200 can perform decoding processing from the core layer to the enhancement layer using encoded data of the current frame, so that it is possible to improve quality of a decoded signal.

Although a case has been described as an example with this embodiment where replacement determining section 103 determines to replace encoded data if one of the determination criteria of ST2002 and ST2004 is met, it is also possible to determine to replace encoded data only when these two criteria are met at the same time.

Further, although a case has been described as an example with this embodiment where replacement determining section 103 determines whether or not the degree of change of the input speech signal is equal to or higher than a predetermined value to determine whether or not the decoding side can perform error compensation in a predetermined level of quality or above using encoded data of the past frame (ST2002), replacement determining section 103 may perform determination by actually performing error compensating processing and decoding processing using encoded data of the past frame assuming that a frame is lost due to packet loss. That is, when the value showing the level of the error difference between a generated decoded signal and an input speech signal is equal to or greater than a predetermined value, that is, the error difference is equal to or greater than a predetermined value, the flow proceeds to ST2006, and, when the value is not equal to or greater than a predetermined value, the flow proceeds to ST2005.

Further, although a case has been described as an example with this embodiment where, to determine the degree of quality improvement of a decoded signal in enhancement layer encoding processing, coding distortion for the case where only core layer encoding processing is performed, and coding distortion for the case where processing up to enhancement layer encoding processing is performed, are calculated in ST2003 in replacement determining processing, it is possible to calculate an SNR instead of coding distortion. In this case, in ST2004, replacement determining section 103 has only to determine whether or not the difference between two SNRs calculated in ST2003 is equal to or smaller than a predetermined value.

Further, although a case has been described as an example with this embodiment where the difference between coding distortion for the case where only core layer encoding processing is performed and coding distortion for the case where processing up to enhancement layer encoding processing is performed, is calculated to determine the degree of quality improvement of a decoded signal in enhancement layer encoding processing (ST2003 and ST2004), when scalable encoding apparatus 100 is an apparatus that realizes frequency band scalability, it is also possible to calculate a bias in the frequency band of an input speech signal, that is, a ratio of the energy of a low-band signal, which is the processing target of core layer encoding section 101, to the energy of a full-band signal.

Still further, although a case has been described as an example with this embodiment where replacement determining section 103 uses input speech signal I(m), core layer encoded data Ec(m) and enhancement layer encoded data Ee(m), it is also possible to use decoded speech signals obtained through core layer encoding and enhancement layer encoding or parameters obtained over the process of encoding processing in addition to Ec(m) and Ee(m), or use the decoded speech signals obtained through core layer encoding and enhancement layer encoding or the parameters obtained over the process of encoding processing instead of Ec(m) and Ee(m).

Furthermore, although a case has been described as an example with this embodiment where core layer decoded signal Dc(n) and enhancement layer decoded signal De (n−1) are used in ST5005 (enhancement layer error compensating processing and decoding processing) in decoding processing, it is also possible to use decoded parameters obtained through core layer decoding processing of the n-th frame and decoded parameters obtained through enhancement layer decoding processing of the (n−1)-th frame instead of Dc(n) and De(n−1). Also in ST5008, ST5009 and ST5010, it is possible to perform error compensating processing and decoding processing using decoded parameters instead of decoded signals.

Further, although a case has been described as an example with this embodiment where scalable encoding apparatus 100 and scalable decoding apparatus 200 are configured with two layers, this is by no means limiting, and scalable encoding apparatus 100 and scalable decoding apparatus 200 can be configured with three or more layers.

Further, although a case has been described as an example with this embodiment where scalable encoding apparatus 100 transmits encoded data delayed by one frame with respect to the input speech signal, to the decoding side, this is by no means limiting, and scalable encoding apparatus 100 may transmit encoded data delayed by two or more frames, to the decoding side. That is, enhancement layer encoded data may be replaced with core layer encoded data of the frame two or more frames after. By this means, even if packets are lost in bursts and two or more frames are lost consecutively, it is possible to perform error compensating processing and decoding processing in a predetermined level of quality or above.

Further, although a case has been described as an example with this embodiment where the number of bits of core layer encoded data Ec(m) and the number of bits of enhancement layer encoded data Ee(m−1) generated by scalable encoding apparatus 100 are the same, when the number of bits of enhancement layer encoded data Ee(m−1) is larger than the number of bits of core layer encoded data Ec(m), part of Ee(m−1) may be replaced with Ec(m). In this case, the remaining part of Ee(m−1), which is not replaced, may or may not be used in decoding processing of scalable decoding apparatus 200.

Embodiment 2

Figure 7:
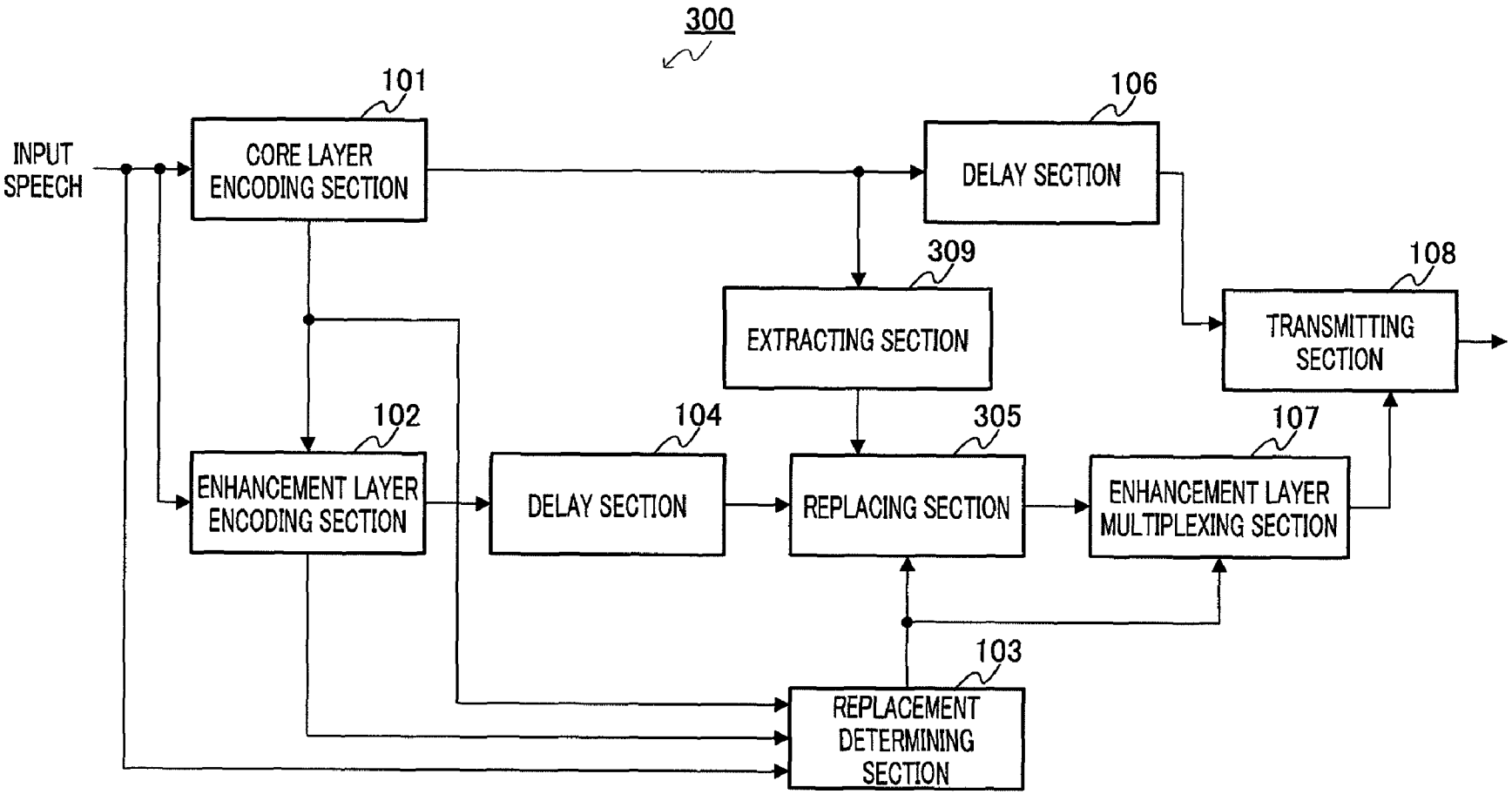
FIG. 7 is a block diagram showing the main configuration of a scalable encoding apparatus according to Embodiment 2.

FIG. 7 is a block diagram showing the main configuration of scalable encoding apparatus 300 according to Embodiment 2 of the present invention. Scalable encoding apparatus 300 adopts the same basic configuration as scalable encoding apparatus 100 (see FIG. 1) according to Embodiment 1, and so the same components will be assigned the same reference numerals without further explanations. Scalable encoding apparatus 300 is different from scalable encoding apparatus 100 in that scalable encoding apparatus 300 further has extracting section 309. Replacing section 305 of scalable encoding apparatus 300 is different from replacing section 105 of scalable encoding apparatus 100 in part of processing, and so different reference numerals are assigned to show the differences.

Extracting section 309 extracts part which greatly contributes to coding quality from Ec(m) inputted from core layer encoding section 101, to generate extracted core layer encoded data Eca(m). For example, when a CELP (Code Excited Linear Prediction) encoding scheme is adopted, LPC (Linear Prediction Coefficient) parameters, adaptive codebook lag and gain are extracted.

When the value of replacement determining flag "flag(m−1)" inputted from replacement determining section 103 is 0, replacing section 305 outputs Ee(m−1) inputted from delay section 104 as is to enhancement layer multiplexing section 107. On the other hand, when flag(m−1) is 1, replacing section 305 replaces part of Ee(m−1) inputted from delay section 104 with extracted core layer encoded data Eca(m) inputted from extracting section 309, and outputs the result to enhancement layer multiplexing section 107.

Figure 8:
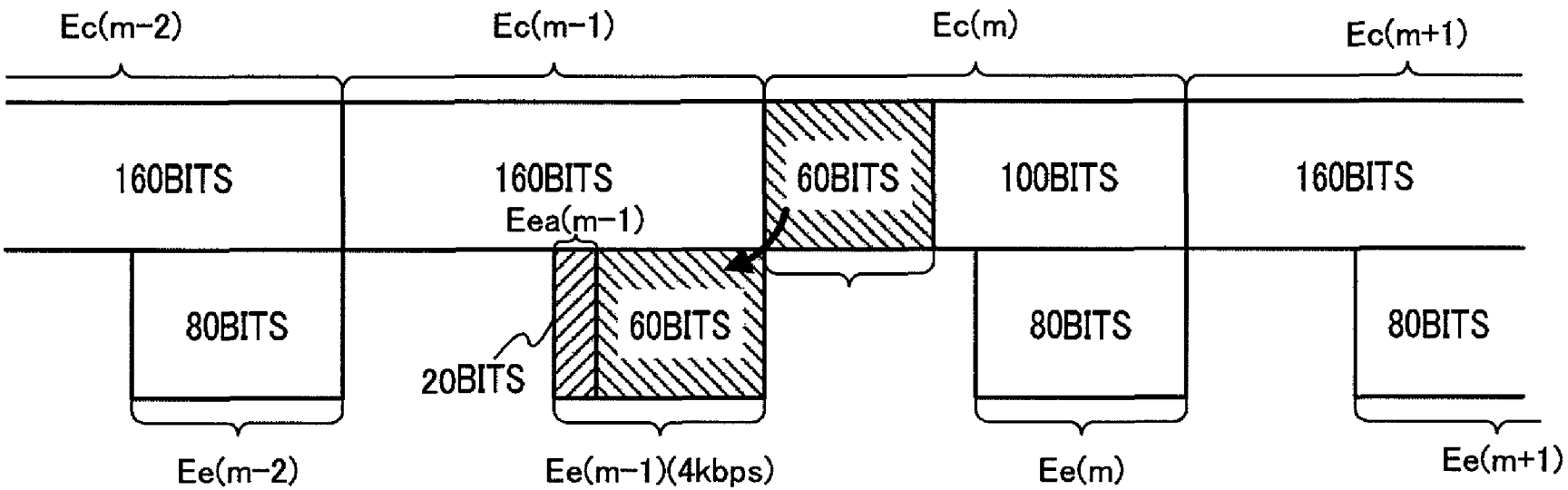
FIG. 8 illustrates processing of replacing part of the enhancement layer encoded data with extracted core layer encoded data.

FIG. 8 illustrates processing of replacing part of enhancement layer encoded data Ee(m−1) of the (m−1)-th frame with extracted core layer encoded data Eca(m) in scalable encoding apparatus 300.

Here, a case will be described as an example where the frame length is 20 ms, the bit rate for core layer encoded data is 8 kbps (160 bits/frame), and the bit rate for enhancement layer encoded data is 4 kbps (80 bits/frame). Extracting section 309 extracts extracted core layer encoded data Eca(m) from 160 bits of Ec(m). That is, when the CELP encoding scheme is adopted, the LPC parameters, adaptive codebook lag and gain are extracted from Ec(m). When extracted Eca (m) is, for example, 3 kbps (60 bits/frame), replacing section 305 extracts part which greatly contributes to coding quality, that is, extracted enhancement layer encoded data Eea(m−1), from enhancement layer encoded data Ee(m−1) at 1 kbps (20 bits/frame). The number of bits of Eea (m−1), 20 bits (per frame), are the difference between 80 bits (per frame) of the number of bits of Ee(m−1) and 60 bits (per frame) of the number of bits of Eca(m). Replacing section 305 replaces parts other than Eea(m−1) with Eca(m) in Ee(m−1). Therefore, data outputted to enhancement layer multiplexing section 107 by replacing section 305 is a set of Eea(m−1) and Eca(m). Here, the method of extracting Eea(m−1) in replacing section 305 is the same as the method of extracting Eca (m) in extracting section 309.

As described above, in Embodiment 1, enhancement layer encoded data of the (m−1)-th frame is replaced using the whole of core layer encoded data of the m-th frame. On the other hand, in this embodiment, part of enhancement layer encoded data Ee(m−1) of the (m−1)-th frame is replaced using part of core layer encoded data Ec(m) of the m-th frame.

Figure 9:
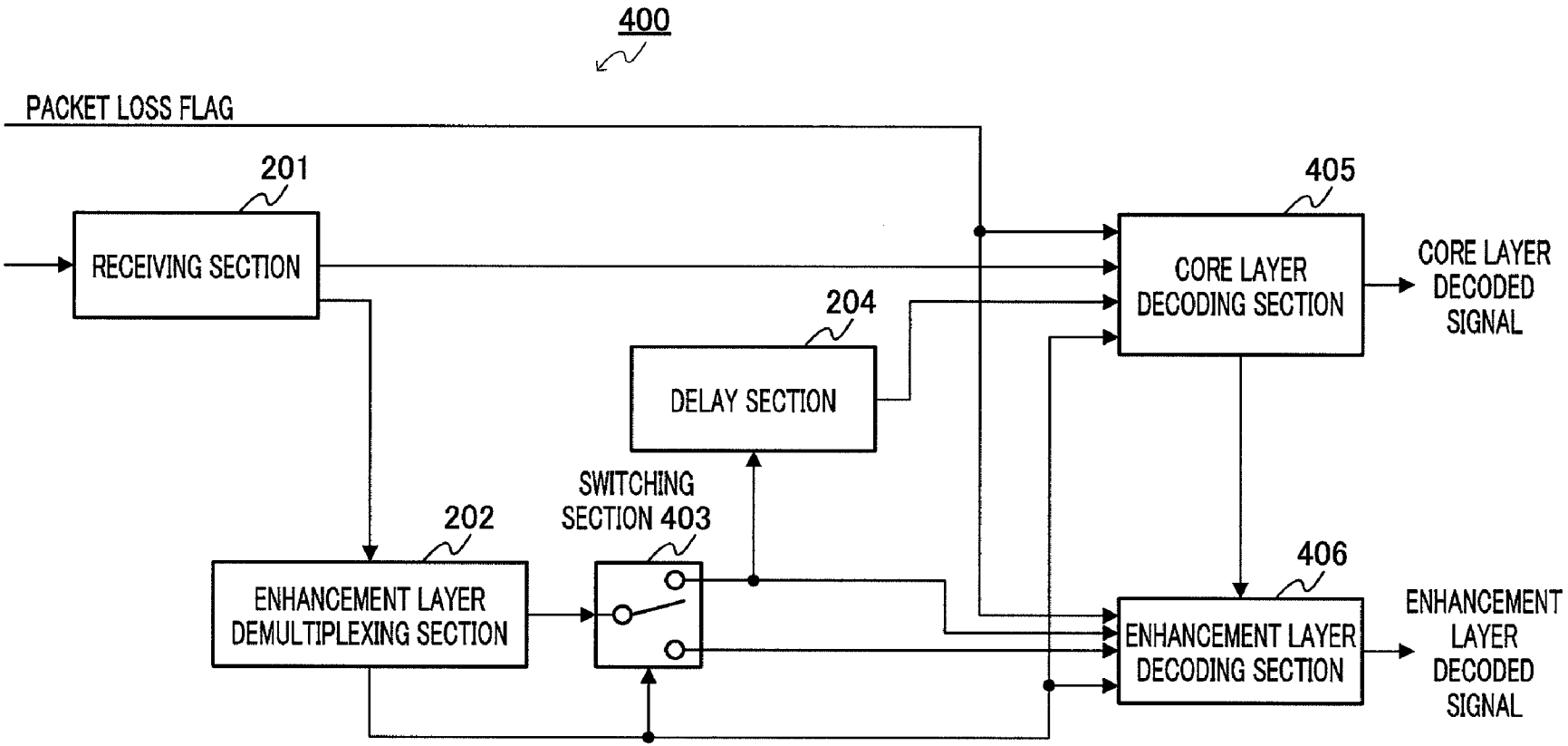
FIG. 9 is a block diagram showing the main configuration of a scalable decoding apparatus according to Embodiment 2.

FIG. 9 is a block diagram showing the main configuration of scalable decoding apparatus 400 according to this embodiment.

Scalable decoding apparatus 400 has the same basic configuration as scalable decoding apparatus 200 according to Embodiment 1 (see FIG. 4), and so the same components will be assigned the same reference numerals without further explanations. Switching section 403, core layer decoding section 405 and enhancement layer decoding section 406 of scalable decoding apparatus 400 are different from switching section 203, core layer decoding section 205 and enhancement layer decoding section 206 of scalable decoding apparatus 200, respectively, in part of processing, and so different reference numerals are assigned to show the differences.

Switching section 403 judges whether the content of enhancement layer encoded data Ee(n) inputted from enhancement layer demultiplexing section 202 is Ee(n) or a set of extracted enhancement layer encoded data Eea(n) and extracted core layer encoded data Eca(n+1) of the next frame, based on the value of replacement determining flag "flag(n)" inputted from enhancement layer demultiplexing section 202, and switches the output destination. To be more specific, when replacement determining flag "flag(n)" is 1, switching section 403 outputs Eca(n+1) to delay section 204 and outputs Eea(n) to enhancement layer decoding section 406. On the other hand, when replacement determining flag "flag(n)" is 0, switching section 403 outputs enhancement layer encoded data Ee(n) to enhancement layer decoding section 406.

Differences in processing between core layer decoding section 405 and enhancement layer decoding section 406, and core layer decoding section 205 and enhancement layer decoding section 206 of scalable decoding apparatus 200, will be described using the flowchart in FIG. 10.

Figure 10:
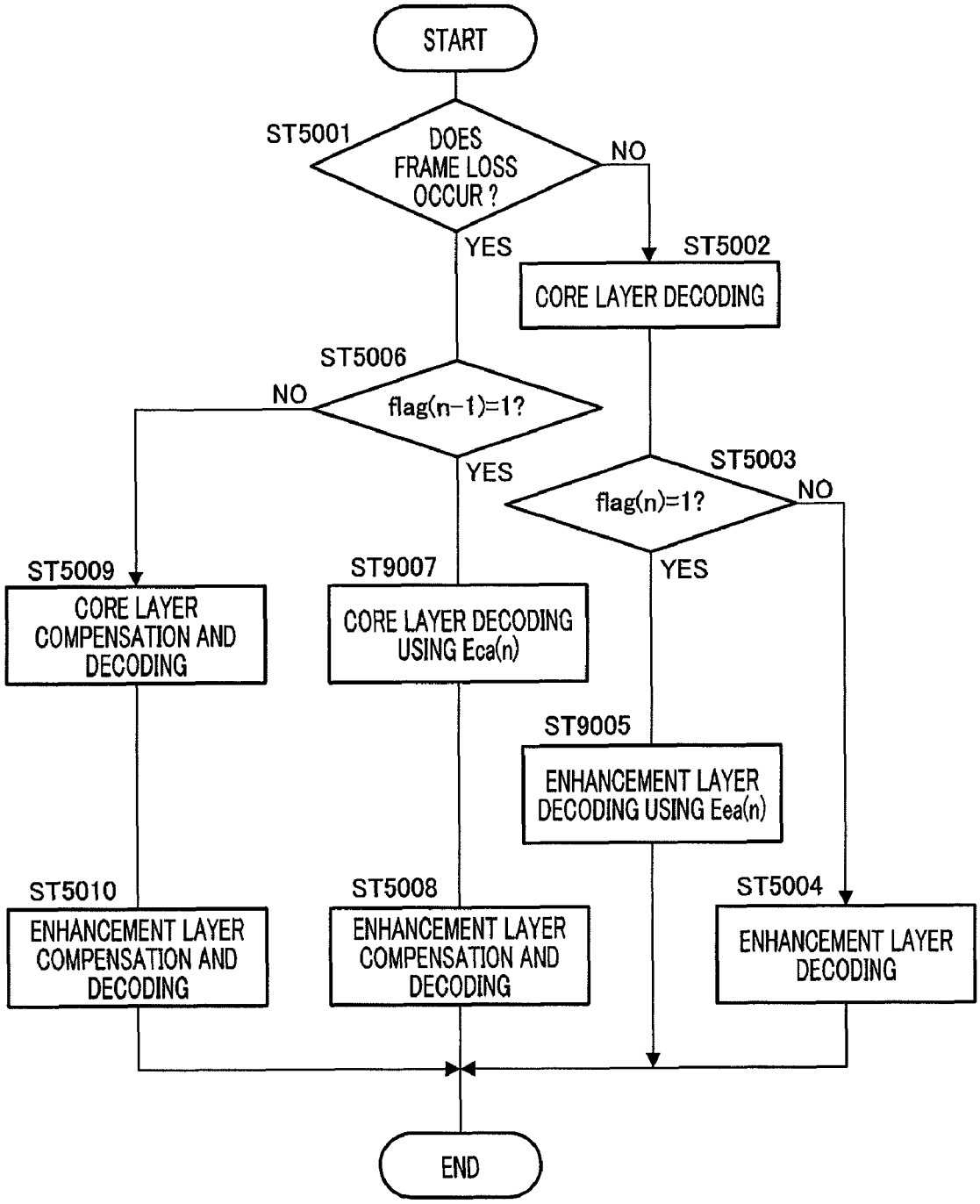
FIG. 10 is a flowchart showing the steps of error compensating processing and decoding processing in a core layer decoding section and an enhancement layer decoding section according to Embodiment 2.

FIG. 10 is a flowchart showing the steps of error compensating processing and decoding processing in core layer decoding section 405 and enhancement layer decoding section 406. This figure has basically the same steps as in the flowchart (FIG. 5) that illustrates error compensating processing and decoding processing in core layer decoding section 205 and enhancement layer decoding section 206 according to Embodiment 1, and so the same steps are assigned the same reference numerals without further explanations. In FIG. 10, the steps different from FIG. 5 are ST9005 and ST9007.

In scalable encoding apparatus 300, the whole of enhancement layer encoded data Ee(n) of the n-th frame is not replaced with core layer encoded data of the next frame, part of Eea(n) is not replaced and transmitted to scalable decoding apparatus 400, and so, in ST9005, enhancement layer decoding section 406 performs enhancement layer decoding processing using Eea(n) and generates enhancement layer decoded signal De(n).

In ST9007, core layer decoding section 405 performs core layer decoding processing using extracted core layer encoded data Eca(n) received in decoding processing of one frame before, and generates core layer decoded signal Dc(n).

In this way, according to this embodiment, by replacing part of enhancement layer encoded data at the encoding side instead of replacing the whole of the enhancement layer encoded data using data obtained by limiting core layer encoded data of the next frame to part which greatly contributes to coding quality, it is possible to perform enhancement layer decoding at the decoding side using part of data which is not replaced in the enhancement layer encoded data. Therefore, it is possible to improve quality of a decoded signal. Further, by limiting data to part which greatly contributes to coding quality, as core layer encoded data used for replacement, it is possible to suppress degradation of a decoded signal by applying this embodiment even when the bit rate for core layer encoding is higher than the bit rate for enhancement layer encoding.

Although a configuration has been described as an example with this embodiment where the encoding side replaces part of enhancement layer encoded data instead of replacing the whole of enhancement layer encoded data, it is also possible to replace the whole of enhancement layer encoded data using data obtained by limiting core layer encoded data of the next frame to part which greatly contributes to coding quality.

Further, although a case has been described as an example with this embodiment where enhancement layer decoding section 406 performs enhancement layer decoding processing using Eea (n) in ST9005 of decoding processing, it is also possible to perform decoding processing using enhancement layer encoded data Ee(n−1) of the (n−1)-th frame and enhancement layer decoded signal De(n−1) in addition to Eea(n).

Furthermore, although a case has been described as an example with this embodiment where extracting section 309 adopts the similar extracting method for all frames, extracting section 309 may adopt different extracting methods according to frames and transmit information relating to the used extracting methods to scalable decoding apparatus 400 separately. By this means, it is possible to suppress quality degradation of a decoded signal generated in scalable decoding apparatus 400.

Embodiment 3

In Embodiments 1 and 2, the encoding side replaces enhancement layer encoded data of the current frame with core layer duplicated data of the next frame (or frames after the next frame). Therefore, data is delayed by one (or more than one) frame more at the encoding side. On the other hand, in this embodiment, the encoding side adopts a configuration for replacing enhancement layer encoded data of the current frame with core layer duplicated data of the frame before the current frame. By adopting this configuration, although extra delay is not produced at the encoding side, delay of one frame more is produced at the decoding side.

Figure 11:
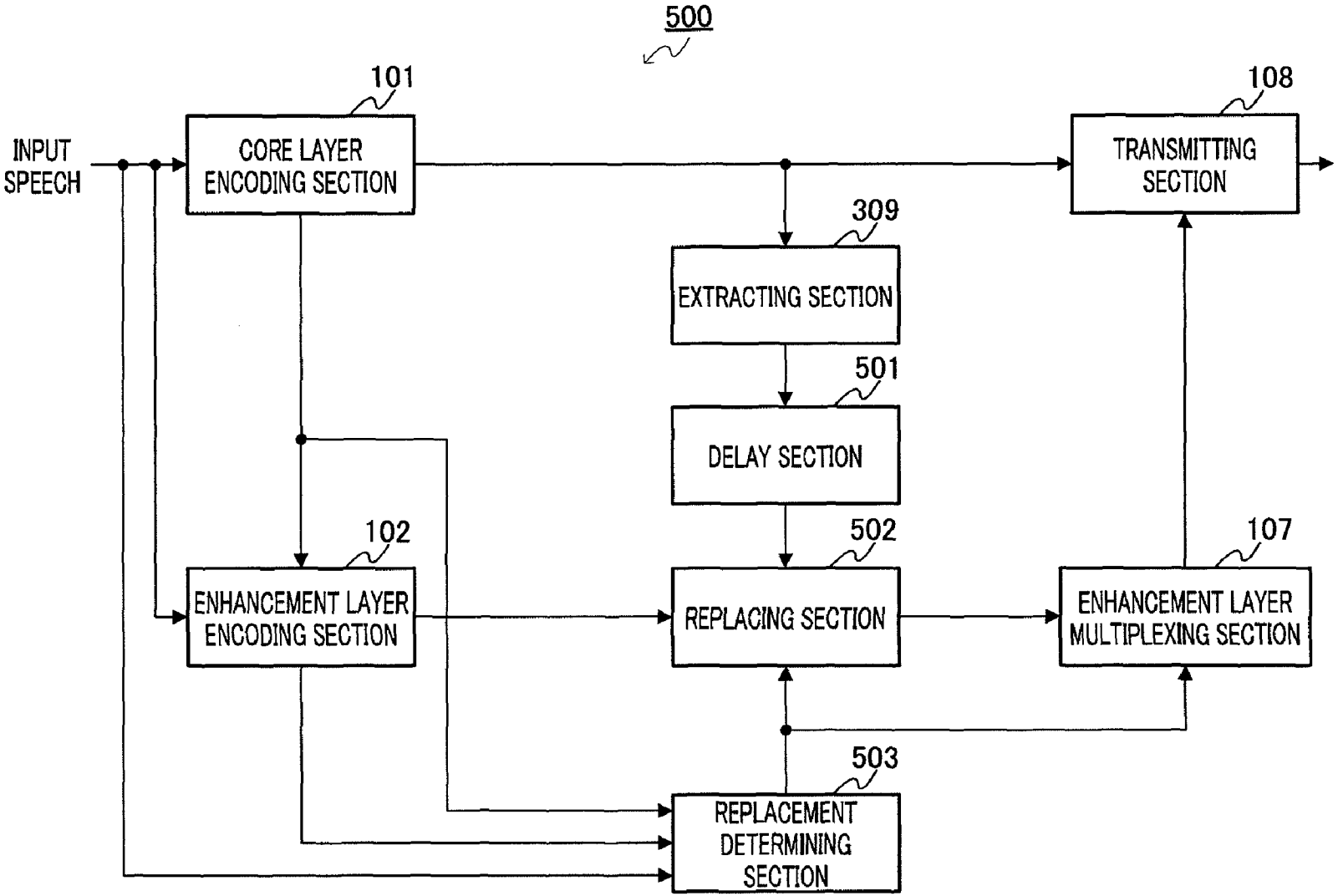
FIG. 11 is a block diagram showing the main configuration of a scalable encoding apparatus according to Embodiment 3.

FIG. 11 is a block diagram showing the main configuration of scalable encoding apparatus 500 according to Embodiment 3 of the present invention. Scalable encoding apparatus 500 adopts a configuration similar in part to scalable encoding apparatus 300 described in Embodiment 2 (see FIG. 7), and so the same components will be assigned the same reference numerals without further explanations.

When scalable encoding apparatus 500 is compared with scalable encoding apparatus 300, the differences are that delay sections 104 and 106 are removed and delay section 501 is added instead. The details will be described below.

Core layer encoded data Ec(m) of the m-th frame, which is an output of core layer encoding section 101, is outputted to transmitting section 108 directly. Further, enhancement layer encoded data Ee(m) of the m-th frame, which is an output of enhancement layer encoding section 102, is outputted to replacing section 502 directly. Still further, extracted core layer encoded data Eca(m), which is an output of extracting section 309, is delayed by one frame by delay section 501, and outputted to replacing section 502 as extracted core layer encoded data Eca(m−1) of the (m−1)-th frame.

Replacement determining section 503 performs replacement determining processing for determining whether or not to replace part of enhancement layer encoded data Ee(m) of the m-th frame with part of core layer encoded data Ec(m−1) of the (m−1)-th frame using the input speech signal, core layer encoded data inputted from core layer encoding section 101 and enhancement layer encoded data inputted from enhancement layer encoding section 102. To be more specific, replacement determining section 503 determines whether the decoding side can perform error compensation on the decoded signal of the (m−1)-th frame in a predetermined level of quality or above using the encoded data of the past frame, or whether the degree of quality improvement of a decoded signal through enhancement layer encoding processing of the m-th frame is equal to or lower than a predetermined level when the encoded data of the (m−1)-th frame is lost. When these criteria are met, replacement determining section 503 determines to perform the above-described replacement. Replacement determining section 503 outputs replacement determining flag "flag(m)" showing the determination result of the m-th frame to replacing section 502 and enhancement layer multiplexing section 107.

When the value of replacement determining flag "flag(m)" inputted from replacement determining section 503 is 0, that is, when replacement determining section 503 determines not to perform replacement, replacing section 502 outputs Ee(m) as is to enhancement layer multiplexing section 107. On the other hand, when flag(m) is 1, that is, when replacement determining section 503 determines to perform replacement, replacing section 502 replaces part of Ee(m) with extracted core layer encoded data Eca (m−1) and outputs the result to enhancement layer multiplexing section 107.

Replacement determining flag "flag(m)" and enhancement layer encoded data Ee(m) are multiplexed at enhancement layer multiplexing section 107 and transmitted to the decoding side through transmitting section 108.

Although a configuration has been described where, when replacement determining flag "flag(m)" is 1, replacing section 502 of scalable encoding apparatus 500 replaces part of enhancement layer encoded data Ee(m) with extracted core layer encoded data Eca(m−1), which is extracted from core layer encoded data Ec(m) at extracting section 309 and delayed, it is also possible to adopt a configuration for replacing part or all of Ee(m) with data Ec(m−1), which is obtained by delaying core layer encoded data Ec(m) by one frame without extracting part of the data.

Further, a configuration has been described where, when replacement determining flag "flag(m)" is 1, replacing section 502 replaces part of enhancement layer encoded data Ee(m) encoded at enhancement layer encoding section 102 with extracted core layer encoded data Eca(m−1). However, when replacement determining flag "flag(m)" is 1, it is also possible to perform enhancement layer encoding at enhancement layer encoding section 102, using a number of bits that are a number of bits equivalent to extracted core layer encoded data Eca(m−1) fewer than in the case where flag(m) is 0, and output the obtained enhancement layer encoded data Eep(m) and extracted core layer encoded data Eca(m−1) to enhancement layer multiplexing section 107.

Still further, although a configuration has been described where, only when replacement determining flag "flag(m)" is 1 as a result of determination at replacement determining section 503, replacing section 502 replaces part of Ee(m) with extracted core layer encoded data Eca(m−1), replacing section 502 may replace part of Ee(m) with extracted core layer encoded data Eca(m−1) in any case regardless of the determination result at replacement determining section 503.

Next, scalable decoding apparatus 600 according to this embodiment, which supports scalable encoding apparatus 500, will be described.

Figure 12:
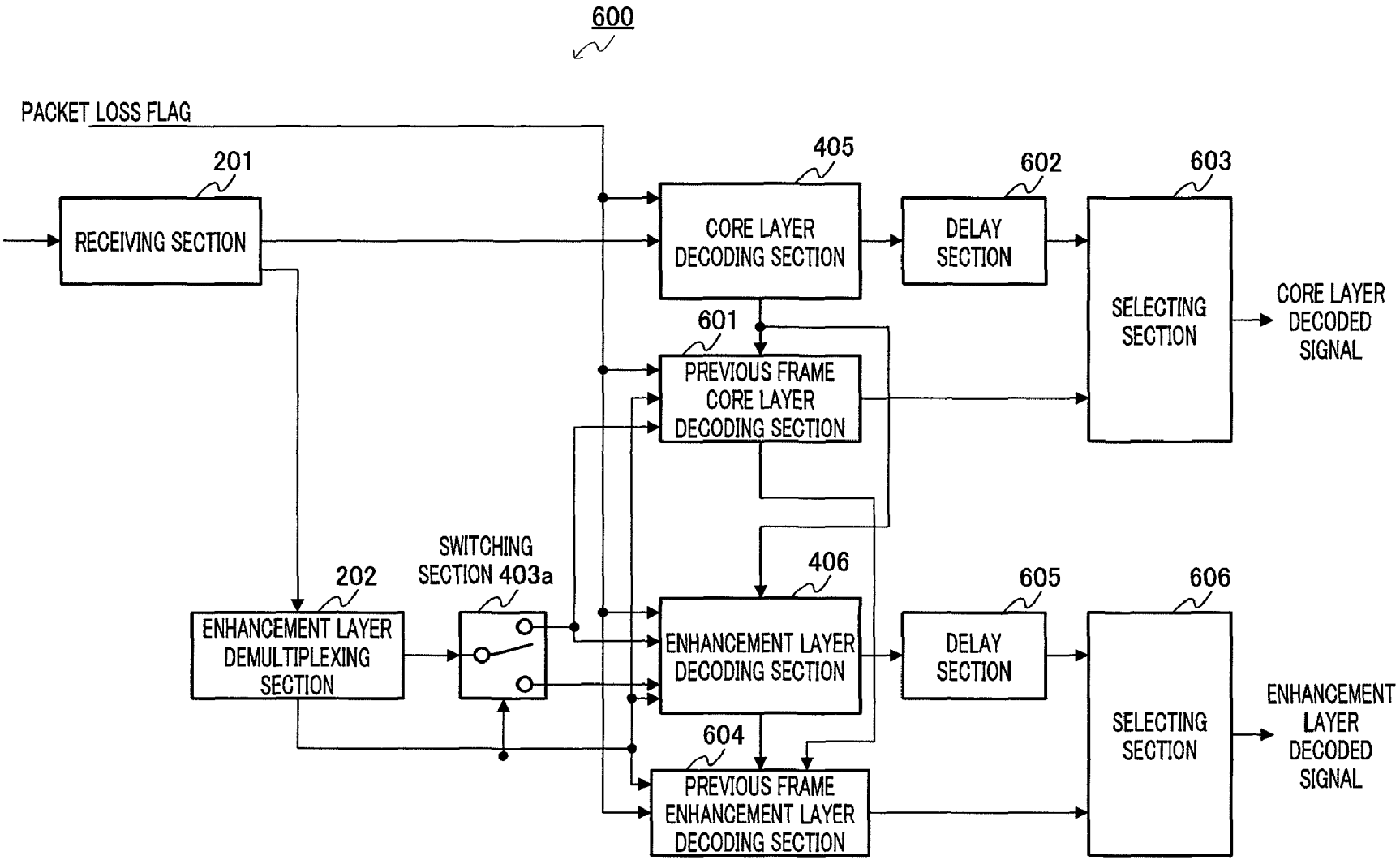
FIG. 12 is a block diagram showing the main configuration of a scalable decoding apparatus according to Embodiment 3.

FIG. 12 is a block diagram showing the main configuration of scalable decoding apparatus 600. The same components as those of scalable decoding apparatus 400 (see FIG. 9) described in Embodiment 2 will be assigned the same reference numerals without further explanations. Further, a case will be described as an example where scalable decoding apparatus 600 receives encoded data of the n-th frame transmitted from scalable encoding apparatus 500 and performs decoding processing. n and m has the relationship that satisfies n=m.

Switching section 403*a* judges whether content of enhancement layer encoded data Ee(n) inputted from enhancement layer demultiplexing section 202 is Ee(n) itself or a set of extracted enhancement layer encoded data Eea(n) and extracted core layer encoded data Eca (n−1) of the previous frame, based on the value of replacement determining flag "flag(n)" inputted from enhancement layer demultiplexing section 202, and switches the output destination. To be more specific, when replacement determining flag "flag(n)" is 1, switching section 403*a* outputs the set of Eea(n) and Eca(n−1) to previous frame core layer decoding section 601 and enhancement layer decoding section 406. On the other hand, when replacement determining flag "flag(n)" is 0, switching section 403*a* outputs enhancement layer encoded data Ee(n) to enhancement layer decoding section 406.

Core layer decoding section 405 switches processing based on a packet loss flag, and, when there is no packet loss in the n-th flame, performs decoding processing using core layer encoded data Ec(n). On the other hand, when a packet loss occurs in the n-th frame, core layer decoding section 405 performs error compensating processing using core layer encoded data received in the past to generate core layer decoded signal Dc(n).

Previous frame core layer decoding section 601 judges whether or not packet loss occurs in the (n−1)-th frame and partial replacement is performed in the encoded data, using both the packet loss flag and replacement determining flag "flag(n)". When there is a packet loss in the (n−1)-th frame and partial replacement is performed in the encoded data, previous frame core layer decoding section 601 generates core layer decoded signal Dc_r(n−1) of the (n−1)-th frame using extracted core layer encoded data Eca(n−1) of the (n−1)-th frame inputted from switching section 403*a*, core layer encoded data of the n-th frame inputted from core layer decoding section 405 and core layer encoded data of the frame that precedes the n-th frame, inputted from the same core layer decoding section 405.

Delay section 602 delays core layer decoded signal Dc(n) of the n-th frame outputted from core layer decoding section 405 by one frame, to obtain decoded signal Dc(n−1) of the (n−1)-th frame, and outputs this to selecting section 603.

When core layer decoded signal Dc_r(n−1) is outputted from previous frame core layer decoding section 601, selecting section 603 outputs this signal as a core layer decoded signal, and, when core layer decoded signal Dc_r(n−1) is not outputted, that is, when core layer decoded signal Dc(n−1) is outputted from delay section 602, selecting section 603 outputs this as a decoded signal.

Enhancement layer decoding section 406 switches processing based on a packet loss flag, and, when there is no packet loss, performs normal decoding processing and outputs enhancement layer decoded signal De(n). Further, when a packet loss occurs, enhancement layer decoding section 406 performs error compensation using enhancement layer encoded data received in the past and compensated data generated in core layer decoding section 405. To be more specific, normal decoding processing is performed using enhancement layer encoded data Ee(n) or extracted enhancement layer encoded data Eea(n) inputted from switching section 403*a*, replacement determining flag "flag(n)" inputted from enhancement layer demultiplexing section 202, core layer encoded data Ec(n) inputted from core layer decoding section 405 and core layer decoded signal Dc(n) inputted from core layer decoding section 405.

Previous frame enhancement layer decoding section 604 judges whether or not a packet loss occurs in the (n−1)-th frame and partial replacement is performed in the encoded data based on the packet loss flag and replacement determining flag "flag(n)". When a packet loss occurs in the (n−1)-th frame and partial replacement is performed in the encoded data, previous frame enhancement layer decoding section 604 performs error compensation of the enhancement layer to generate enhancement layer decoded signal De_r(n−1) using core layer encoded data of the (n−1)-th frame inputted from previous frame core layer decoding section 601, core layer decoded signal, enhancement layer encoded data of the n-th frame inputted from enhancement layer decoding section 406 and enhancement layer encoded data of the frame that precedes the n-th frame, inputted from the same enhancement layer decoding section 406.

Delay section 605 delays enhancement layer decoded signal De(n) of the n-th frame outputted from enhancement layer decoding section 406 by one frame, to obtain decoded signal De(n−1) of the (n−1)-th frame and outputs this to selecting section 606.

When enhancement layer decoded signal De_r(n−1) is outputted from previous frame enhancement layer decoding section 604, selecting section 606 outputs this signal as an enhancement layer decoded signal, and, when enhancement layer decoded signal De_r(n−1) is not outputted, that is, when enhancement layer decoded signal De(n−1) is outputted from delay section 605, selecting section 606 outputs this as a decoded signal.

Figure 13:
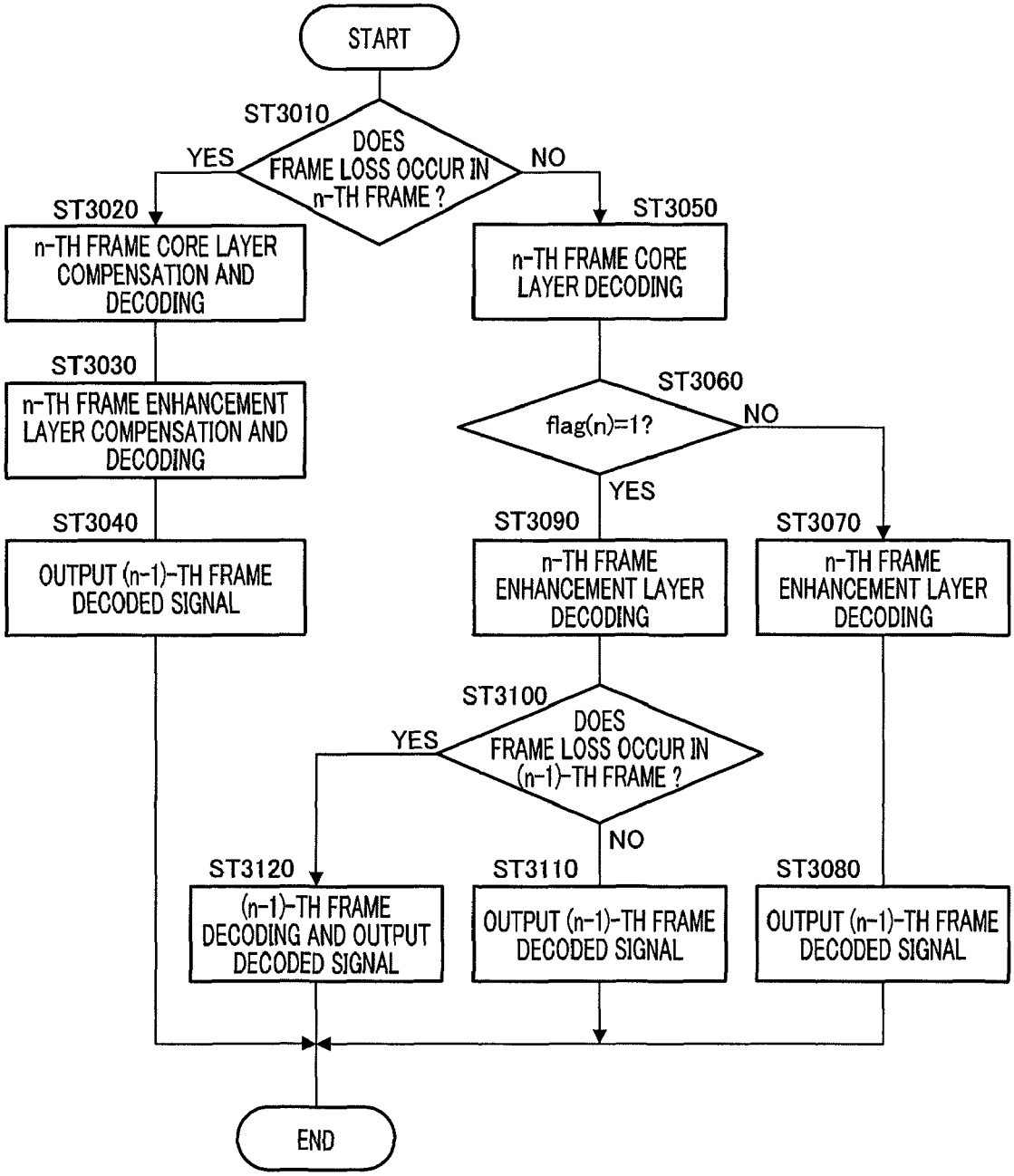
FIG. 13 is a flowchart showing a series of steps of decoding processing according to Embodiment 3.

FIG. 13 is a flowchart showing a series of steps of the above-described decoding processing of scalable decoding apparatus 600 according to this embodiment.

First, core layer decoding section 405 and enhancement layer decoding section 406 of scalable decoding apparatus 600 judge whether or not encoded data of the n-th frame is lost, based on a packet loss flag (ST3010).

When it is judged in ST3010 that encoded data of the n-th frame is lost, core layer decoding section 405 performs error compensating processing and decoding processing using core layer encoded data Ec(n−1) and core layer decoded signal Dc(n−1) of the (n−1)-th frame, to generate core layer decoded signal Dc (n) of the n-th frame (ST3020). Further, enhancement layer decoding section 406 performs error compensating processing and decoding processing using core layer encoded data Ec(n−1), core layer decoded signal Dc(n−1), enhancement layer encoded data Ee(n−1) and enhancement layer decoded signal De (n−1) of the (n−1)-th frame, to generate enhancement layer decoded signal De(n) of the n-th frame (ST3030).

The (n−1)-th frame that is generated in core layer decoding section 405 and that comes through delay section 602, that is, core layer decoded signal Dc(n−1) of one frame before, and enhancement layer decoded signal De(n−1) of the (n−1)-th frame that is generated in enhancement layer decoding section 406 and that comes through delay section 605, are outputted (ST3040).

On the other hand, when it is judged in ST3010 that there is no loss in the encoded data of the n-th frame, core layer decoding section 405 of scalable decoding apparatus 600 performs core layer decoding processing using core layer encoded data Ec(n) of the n-th frame, to generate core layer decoded signal Dc(n) of the n-th frame (ST3050).

Next, enhancement layer decoding section 406 judges whether or not replacement determining flag "flag(n)" of the n-th frame is 1 (ST3060).

When the value of replacement determining flag "flag(n)" is 0 in ST3060, that is, "no replacement," enhancement layer decoding section 406 performs enhancement layer decoding processing using enhancement layer encoded data Ee(n) of the n-th frame to generate enhancement layer decoded signal De(n) of the n-th frame (ST3070).

Core layer decoded signal Dc(n−1) of the (n−1)-th frame that is generated at core layer decoding section 405 and that comes through delay section 602, and enhancement layer decoded signal De(n−1) of the (n−1)-th frame that is generated at enhancement layer decoding section 406 and that comes through delay section 605, are outputted (ST3080).

On the other hand, in ST3060, when the value of replacement determining flag "flag(n)" is 1, that is, "replacement," enhancement layer decoding section 406 performs enhancement layer decoding processing using extracted enhancement layer encoded data Eea(n) of the n-th frame to generate enhancement layer decoded signal De(n) of the n-th frame (ST3090).

In this case, previous frame core layer decoding section 601 judges whether or not encoded data of the (n−1)-th frame is lost (ST3100).

When it is judged in ST3100 that encoded data of the (n−1)-th frame is not lost, core layer decoded signal Dc(n−1) of the (n−1)-th frame that is generated in core layer decoding section 405 and that comes through delay section 602, and enhancement layer decoded signal De (n−1) of the (n−1)-th frame that is generated in enhancement layer decoding section 406 and that comes through delay section 605, are outputted (ST3110).

When it is judged in ST3100 that encoded data of the (n−1)-th frame is lost, previous frame core layer decoding section 601 generates core layer decoded signal Dc_r (n−1) of the (n−1)-th frame using extracted core layer encoded data Eca (n−1) of the (n−1)-th frame. Further, previous frame enhancement layer decoding section 604 generates enhancement layer decoded signal De_r(n−1) of the (n−1)-th frame using compensated data generated at enhancement layer decoding section 406 through enhancement layer compensating processing of the (n−1)-th frame. The generated core layer decoded signal Dc_r(n−1) and enhancement layer decoded signal De_r(n−1) are outputted as decoded signals of the (n−1)-th frame through selecting sections 603 and 606, respectively.

Although a case has been described as an example where decoded data required for decoding processing at previous frame core layer decoding section 601 is inputted from core layer decoding section 405, it is also possible to input and output between previous frame core layer decoding section 601 and core layer decoding section 405, the decoded data required to be used and updated over the process of decoding processing in these sections. In the same way, it is also possible to input and output between previous frame enhancement layer decoding section 604 and enhancement layer decoding section 406, the decoded data for these sections.

Further, as enhancement layer decoded signal De_r(n−1) of the (n−1)-th frame, it is also possible to use the same signal as lower layer decoded signal Dc_r(n−1) of the (n−1)-th frame, which is decoded at previous frame core layer decoding section 601 using extracted core layer encoded data Eca (n−1) of the (n−1)-th frame.

As described above, according to this embodiment, the encoding side replaces enhancement layer encoded data of the current frame with core layer duplicated data of the frame before the current frame. Therefore, although extra delay is not produced at the encoding side, delay of one frame more is produced at the decoding side.

Therefore, this embodiment is suitable for the case described below. That is, when CELP encoding is adopted for core layer encoding and MDCT where the transform length is double the encoding frame is adopted for transform encoding, data is delayed by one frame more at the scalable decoding apparatus in enhancement layer decoding processing than core layer decoding processing. That is, the delay due to the algorithm required in enhancement layer encoding and decoding processing is necessarily greater than the delay due to the algorithm required in core layer encoding and decoding processing.

In this case, according to the configuration of this embodiment, by keeping the extra delay produced at the decoding side within the range of the delay of one frame due to the algorithm originally required in enhancement layer decoding processing, it is possible to prevent occurrence of apparent delay. For example, in the above-described case, as a result of decoding processing of the n-th frame, enhancement layer decoding section 406 of scalable decoding apparatus 600 always generates and outputs enhancement layer decoded signal De(n−1) of the (n−1)-th frame, which is delayed by one frame. Therefore, delay section 605 described in this embodiment is not necessary in the above-described case.

In this way, this embodiment is suitable for a case where the delay due to the algorithm required in enhancement layer encoding and decoding processing is greater than the delay due to the algorithm required in core layer encoding and decoding processing, such as a case where CELP encoding is adopted for core layer encoding and transform encoding is adopted for enhancement layer encoding.

Embodiments of the present invention have been described.

The scalable encoding apparatus, scalable decoding apparatus, scalable encoding method and scalable decoding method according to the present invention are not limited to the above-described embodiments, and can be implemented with various modifications.

The scalable encoding apparatus and scalable decoding apparatus according to the present invention can be provided to a communication terminal apparatus and a base station apparatus in a mobile communication system, and it is thereby possible to provide a communication terminal apparatus, a base station apparatus and a mobile communication system having the same operational effect as described above.

Here, cases have been described as an example where the present invention is implemented with hardware, but the present invention can also be implemented with software. For example, the functions similar to those of the scalable encoding apparatus and scalable decoding apparatus according to the present invention can be realized by describing an algorithm of the scalable encoding method and scalable decoding method according to the present invention in a programming language, storing this program in a memory and causing an information processing section to execute the program.

Each function block used to explain the above-described embodiments may be typically implemented as an LSI constituted by an integrated circuit. These may be individual chips or may partially or totally contained on a single chip.

Furthermore, here, each function block is described as an LSI, but this may also be referred to as "IC," "system LSI," "super LSI," "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor in which connections and settings of circuit cells within an LSI can be reconfigured is also possible.

Further, if integrated circuit technology comes out to replace LSI's as a result of the development of semiconductor technology or a derivative other technology, it is naturally also possible to carry out function block integration using this technology. Application of biotechnology is also possible.

The present application is based on Japanese Patent Application No. 2005-300777, filed on Oct. 14, 2005, and Japanese Patent Application No. 2005-379335, filed on Dec. 28, 2005, the entire content of which is expressly incorporated by reference herein.

INDUSTRIAL APPLICABILITY

The scalable encoding apparatus, scalable decoding apparatus, scalable encoding method and scalable decoding method according to the present invention are applicable to speech encoding and the like.

The invention claimed is:

1. A scalable encoding apparatus that is configured with at least a lower layer and a higher layer, comprising:

a lower layer encoder that performs encoding in the lower layer to generate lower layer encoded data;

a higher layer encoder that performs encoding in the higher layer to generate higher layer encoded data;

a duplicator that generates duplicated data of the lower layer encoded data; and a replacer that replaces part of the higher layer encoded data with the duplicated data.

2. The scalable encoding apparatus according to claim 1, wherein the replacer replaces the higher layer encoded data of a frame that precedes a specific frame, using the duplicated data of lower layer encoded data of the specific frame.

3. The scalable encoding apparatus according to claim 2, further comprising a determiner that determines the specific frame according to a predetermined criterion, wherein the replacer performs the replacement using the duplicated data of the specific frame determined in the determiner.

4. The scalable encoding apparatus according to claim 3, wherein the determiner determines a frame including one of an onset of a speech signal, a frame including an unvoiced non-stationary consonant part, and a speech frame of a non-stationary signal, as the specific frame.

5. The scalable encoding apparatus according to claim 3, wherein the determiner determines a frame where a degree of change of a parameter showing a characteristic of an input signal is at least equal to a predetermined level, as the specific frame.

6. The scalable encoding apparatus according to claim 5, wherein the determiner uses power of one of a speech signal, a pitch period, a pitch prediction gain and a linear prediction coefficient parameter, as the parameter.

7. The scalable encoding apparatus according to claim 3, wherein the determiner compares coding distortion included in decoded data from the lower layer encoded data and coding distortion included in decoded data from both the lower layer encoded data and the higher layer encoded data, and determines a contribution to a decrease in the coding distortion of the higher layer encoded data, and determines a frame where the contribution is at least equal to a predetermined level as the specific frame.

8. The scalable encoding apparatus according to claim 3, wherein the determiner calculates a ratio of a lower-band energy to a full-band energy in an input signal and determines a frame where the ratio is at least equal to a predetermined level as the specific frame.

9. The scalable encoding apparatus according to claim 2, further comprising an extractor that extracts part of data from the lower layer encoded data of the specific frame, wherein the duplicator generates duplicated data of the part of data.

10. The scalable encoding apparatus according to claim 9, wherein the extractor extracts data including at least one of a linear prediction coefficient parameter, an adaptive codebook lag and a gain, as the part of data.

11. The scalable encoding apparatus according to claim 2, wherein the replacer replaces part of data, out of the higher layer encoded data of a frame that precedes the specific frame, with the duplicated data.

12. The scalable encoding apparatus according to claim 11, wherein the replacer selects data including none of a linear prediction coefficient parameter, an adaptive codebook lag and a gain, as the part of data.

13. A communication terminal apparatus comprising the scalable encoding apparatus according to claim 1.

14. A base station apparatus comprising the scalable encoding apparatus according to claim 1.

15. A scalable decoding apparatus configured with at least a lower layer and a higher layer, comprising:

a demultiplexer that demultiplexes duplicated data of a lower layer encoded data from a higher layer encoded data;

a detector that detects a loss of a frame;

a lower layer decoder that decodes the duplicated data to generate first decoded data when the loss of a frame is detected; and a higher layer decoder that, when the loss of a frame is detected, compensates for the lost frame using the first decoded data to generate second decoded data.

16. The scalable decoding apparatus according to claim 15, wherein the demultiplexer demultiplexes the duplicated data from the higher layer encoded data of a frame that precedes the lost frame.

17. A communication terminal apparatus comprising the scalable decoding apparatus according to claim 15.

18. A base station apparatus comprising the scalable decoding apparatus according to claim 15.

19. A scalable encoding method comprising using a replacer to replace part of an enhancement layer encoded data with backup data of a core layer encoded data.

20. A scalable encoding method used in a scalable encoding apparatus that is configured with at least a lower layer and a higher layer, comprising:

performing encoding, via a lower layer encoder, in the lower layer to generate lower layer encoded data;

performing encoding, via a higher layer encoder, in the high layer to generate higher layer encoded data;

generating, via a generator, duplicated data of the lower layer encoded data; and replacing, using a replacer, part of the higher layer encoded data with the duplicated data.

21. A scalable decoding method used in a scalable decoding apparatus that is configured with at least a lower layer and a higher layer, comprising:

demultiplexing, via a demultiplexer, duplicated data of lower layer encoded data from high layer encoded data;

detecting, via a detector, a loss of a frame;

decoding, via a decoder, the duplicated data to generate first decoded data when the loss of a frame is detected; and compensating, via a compensator, for the lost frame using the first decoded data and generating second decoded data when the loss of a frame is detected.

* * * * *